US005344120A

United States Patent [19]

Tam et al.

[11] Patent Number: 5,344,120

[45] Date of Patent: Sep. 6, 1994

[54] AIRLESS SPRAY GUN NEEDLE ASSEMBLY

[75] Inventors: Jimmy W. S. Tam, Shoreview; Lawrence L. Lanerd, Loretto; Albert W. Lubenow, Inver Grove Heights; Tera D. McCutcheon, Coon Rapids, all of Minn.

[73] Assignee: Graco Inc., Minneapolis, Minn.

[21] Appl. No.: 56,676

[22] Filed: May 3, 1993

[51] Int. Cl.[5] ..... B05B 7/02

[52] U.S. Cl. ..... 251/214; 239/583; 239/DIG. 19; 251/322; 251/323; 251/368

[58] Field of Search ..... 239/526, 583, DIG. 19; 251/214, 322, 323, 368

[56] References Cited

U.S. PATENT DOCUMENTS

| | | | |
|---|---|---|---|
| 3,380,705 | 4/1968 | Enssle | 239/583 X |
| 3,469,825 | 9/1969 | DuBois | 261/71 |
| 3,557,824 | 1/1971 | Krehbiel | 251/368 X |
| 4,166,579 | 9/1979 | Beise | 239/526 |
| 4,560,109 | 12/1985 | Teruyuki et al. | 239/583 |
| 4,934,603 | 6/1990 | Lasley | 239/527 |
| 4,959,159 | 9/1990 | Mattson | 239/526 |
| 5,050,804 | 9/1991 | Svendsen et al. | 239/296 |
| 5,078,322 | 1/1992 | Torntore | 239/289 |
| 5,085,370 | 2/1992 | Smith | 239/71 |
| 5,094,402 | 3/1992 | Perret | 239/526 |

*Primary Examiner*—Robert G. Nilson

*Attorney, Agent, or Firm*—Douglas B. Farrow

[57] ABSTRACT

A needle assembly for an airless spray gun is provided with a needle which is centerless ground and electropolished to greatly increase life. Further life enhancements are gained by use of a plastic needle bushing in the needle clamp and provision of a specific length to diameter geometry for the needle yields enhanced life as well.

4 Claims, 1 Drawing Sheet

AIRLESS SPRAY GUN NEEDLE ASSEMBLY

BACKGROUND OF THE INVENTION

Airless spray guns have been sold and used for many years. Typical of such spray guns is the Silver Gun TM airless spray gun sold by Graco Inc., the assignee of the instant invention. The instruction form for that product, publication no. 307-046 is hereby incorporated by reference. The needle assembly in such guns is desirably designed for a long life and corrosion resistance and includes a ball seal and a ball retainer. The ball retainer has a needle attached via a set screw and the other end of the needle is retained by a needle clamp which also has a set screw.

A packing housing is located on the needle intermediate the two ends. A spring is contained between a packing retainer and the ball retainer. Because of the geometry of where the trigger of such spray guns contacts the needle, non-axial forces are imposed on the needle, and the needle can be prone to breakage prior to the seal or ball wearing out.

SUMMARY OF THE INVENTION

It is therefore an object of this invention to provide an airless spray gun needle assembly which is capable of greatly enhanced life and yet which is easy and inexpensive to manufacture.

Towards, that end, where the needle passes into the reduced diameter section of the needle clamp for attachment via set screw, a relatively soft plastic needle bushing is utilized. Also, the needle itself is centerless ground and electropolished which yields greatly enhanced life.

While previous needles were plated over their complete length, in the instant invention only the seal end of the needle is plated. As a result of this design, needle life is greatly enhanced, in that it is increased at least two and a half times.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
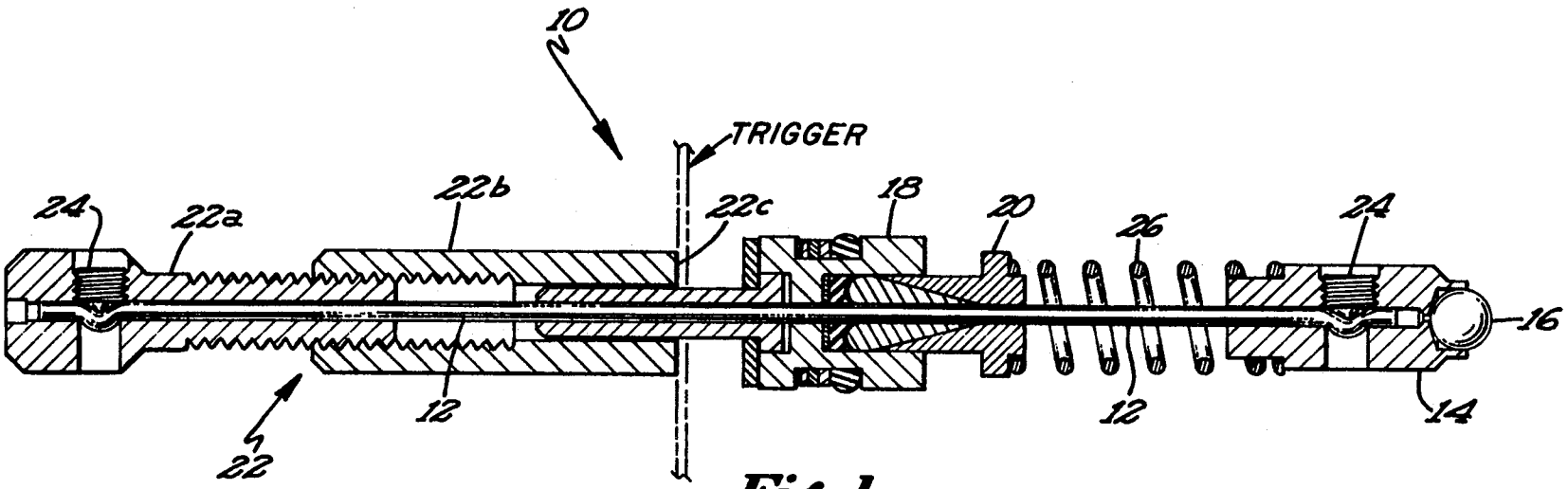
Fig 1 PRIOR ART
FIG. 1 is a cross sectional view showing the prior art needle.

In the prior art device, the needle assembly, generally designated (10) is comprised of a needle (12), a ball retainer (14), a ball (16), a packing housing (18), a packing retainer (20) and a needle clamp (22). In the prior art, needle clamp (22) is comprised of two pieces **(22*a* and 22*b*) threadedly connected to one another and a set screw (24) holds needle (12) in place and needle retainer (22). A spring (26) is imposed between ball retainer (14) and packing retainer (20). When the trigger of the gun is desired to be actuated, the trigger shown in dotted lines in FIG. 1 presses against the surface of (22*c*) of needle retainer (22) causing it to move to the left as shown in FIG. 1**.

Figure 2:
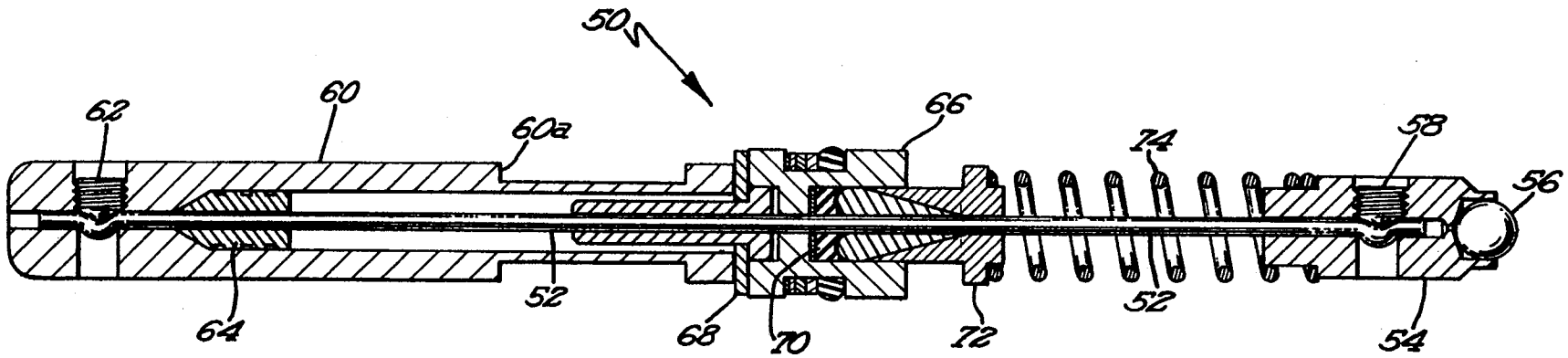
FIG. 2 is a cross sectional view of the needle of the instant invention.

The instant invention shown generally in FIG. 2 is designated generally by the reference numeral (50). Needle (52) is located at one end in ball retainer (54) which has ball (56) located on the end thereof. A set screw (58) holds needle (52) in place. At the other end of needle (52), a needle retainer (60) serves to retain the end of needle (52) via set screw (62). A needle bushing (64) serves to cushion needle (52) at a stress point that is formed of a soft low density polyethylene material. Located intermediate are packing housing (66), washer (68), packing (70), packing retainer (72), and spring (74). Similarly, trigger bears against surface **(60*a*) of needle retainer (60)** to open it.

Needle (52) is first centerless ground and then electropolished with only one end of the needle being chrome plated primarily where it passes through the sealing area adjacent packing housing (66).

The needle geometry is also important to improved life. In the preferred embodiment, where the needle has a radius R in inches and a length L in inches between said needle clamp and said sealing area, the $L/(R^2)$ ratio is between about 70 and 140.

It is contemplated that various changes and modifications may be made to the needle assembly without departing from the spirit and scope of the invention as defined by the following claims.

What is claimed is:

1. A needle assembly for an airless spray gun, said needle assembly comprising:

a needle; having first and second ends and a sealing area, said needle having a centerless ground and electropolished surface, said needle being plated on one of said ends and unplated on the other of said ends;

a needle retainer retaining said needle first end; and a ball retainer containing said needle second end.

2. The needle assembly of claim 1 further comprising a soft needle bushing in said needle retainer, at said least part of said needle passing into said needle retainer.

3. The needle assembly of claim 2 wherein said needle bushing is comprised of a relatively soft low density polyethylene.

4. The needle assembly of claim 1 wherein said needle has a radius R in inches and a length L in inches between said needle retainer and said sealing area wherein $L/(R^2)$ is between about 70 and 140.

* * * * *